United States Patent [19]

McKenney

[11] 4,396,065

[45] Aug. 2, 1983

[54] PIPE JOINT SEPARATION

[75] Inventor: John R. McKenney, Bartlesville, Okla.

[73] Assignee: Phillips Petroleum Company, Bartlesville, Okla.

[21] Appl. No.: 229,033

[22] Filed: Jan. 28, 1981

[51] Int. Cl.[3] ..... E21B 31/00; E21B 31/107

[52] U.S. Cl. ..... 166/301; 166/65 R; 166/178

[58] Field of Search ..... 166/177, 65 R, 178, 166/301, 99, 98, 249; 29/426.6, 446, DIG. 46

[56] References Cited

U.S. PATENT DOCUMENTS

| | | | |
|---|---|---|---|
| 2,305,261 | 12/1942 | Kinley | 166/299 |
| 2,407,991 | 9/1946 | McCullough | 166/299 X |
| 2,730,176 | 1/1956 | Herbold | 166/177 |
| 2,972,380 | 2/1961 | Bodine, Jr. | 166/46 |
| 3,142,901 | 8/1964 | Bodine | 29/426.6 X |
| 3,152,642 | 10/1964 | Bodine, Jr. | 166/46 |
| 3,168,140 | 2/1965 | Bodine, Jr. | 166/46 |
| 3,180,418 | 4/1965 | MacLeod | 166/177 X |
| 3,189,092 | 6/1965 | Bodine, Jr. | 166/42 |
| 3,199,594 | 8/1965 | Kinley | 166/63 |
| 3,399,724 | 9/1968 | Brooks | 166/301 X |
| 4,074,758 | 2/1978 | Scott | 166/249 |
| 4,343,356 | 8/1982 | Riggs et al. | 166/60 |

FOREIGN PATENT DOCUMENTS

| | | | |
|---|---|---|---|
| 125216 | 3/1957 | U.S.S.R. | 166/301 |

OTHER PUBLICATIONS

E. D. Riggs et al., "New Sonic Shock Tool Removes Well Bore Barriers", Pet. Eng., Sep. 1975, pp. 68, 72 and 74.

*Primary Examiner*—Stephen J. Novosad

[57] ABSTRACT

A shock wave, e.g., from a short time electric arc, is used instead of any explosives to loosen a screw connection between two pipes.

5 Claims, No Drawings

PIPE JOINT SEPARATION

BACKGROUND OF THE INVENTION

When drill pipe, tubing, etc. becomes stuck in longitudinal or radial movement due to cave-ins in the bore hole, it is frequently necessary to remove the free section of the pipe or tubing which is above the point of sticking. To achieve this, it is known in the art to use explosives that are detonated at the first free joint above the stuck point. The use of explosives in this operation is disadvantageous from three aspects:

(1) If a shot fails to result in loosening the joint, then the whole procedure must be repeated, i.e. remove the torque, remove the shot tool, reload, replace shot tool, retorque and fire.

(2) The dynamic pressure pulses of explosives are such that the drill pipe and/or pipe joint could be easily damaged thereby.

(3) Debris resulting from explosive charges can block fluid circulation through the pipe further complicating the recovery procedure.

THE INVENTION

It is thus one object of this invention to provide a method for loosening or separating a screw connection of a pipe conduit in a bore hole which allows fast, simple and efficient separating of such screw connections.

Another object of this invention is to provide a method for loosening or separating a screw connection in a bore hole which method is flexible enough to allow the rapid adaptation of the method to a wide variety of loosening problems.

Still another object of this invention is to provide a process to separate pipe joints with tools involving no hazard.

These and other objects, advantages, details, features and embodiments of this invention will become apparent to those skilled in the art from the following description of the invention and the appended claims.

In accordance with this invention a method for loosening or separating a screw connection of a pipe conduit in a bore hole is provided. In accordance with this process, an unscrewing torque is applied to the connection, and the screw connection while under this torque is subjected to at least one shock wave generated inside of said pipe conduit at or near said screw connection. The shock wave is one that is defined by the presence of a significant pressure increase inside of the pipe connection lasting longer than several nanoseconds. Particularly, the shock wave is created by a spark device and not by an explosive.

The preferred embodiment of this invention involves the generation of a shock wave essentially in the absence of generation of any additional gas in the pipe conduit. The presently preferred tool for generating such a shock wave is a sonic device such as an electric arc discharge. The arc discharge can be generated by providing for an arc space between two shoes or electrodes that are initially short circuited with a piece of conductor such as a piece of wire then a strong electrical current is generated in this wire by applying a voltage between the shoes so that the wire quickly melts or vaporizes causing a short-time electrical current arc to be concentrated between the two shoes or poles.

Shock-wave tools are known as such and their use for removal of well bore flow barriers has been described in Petroleum Engineer, September 1975, p. 68. The sonic shock-wave tool used for this invention will have dimensions to fit inside of the pipe. This invention does not reside in the tool as such, but rather in its application or use.

In the method and process of this invention, it is possible to generate a series of such shock waves without removing the shock wave generating tool from it's operational position. For such an operation following each shock wave, an additional piece of conductor is applied between the shoes or poles and another current pulse is generated through the conductor causing the brief high powered arc to develop between the poles. Since no explosive gases are generated the process is quite safe.

Reasonable variations and modifications which will become apparent to those skilled in the art can be made in this invention without departing from the spirit and scope thereof.

I claim:

1. Method to loosen a screw connection of a pipe conduit in a bore hole comprising:

(a) applying an unscrewing torque to the portion of the pipe above the screw connection, and (b) subjecting said screw connection while under that torque to at least one shock wave generated inside of said pipe conduit at or near said screw connection, by providing two electrodes with an arc space between them inside of said pipe and causing an electrical current arc between the two electrodes such as to cause said shock wave in the essential absence of generation of any additional gas in the pipe.

2. Method in accordance with claim 1 wherein said shock wave is created by a sonic device instead of an explosive.

3. Method in accordance with claim 2 wherein said shock wave is generated by a high power short-time electric arc.

4. Method in accordance with claim 1 wherein said shock wave is generated while maintaining the ambient pressure inside of said pipe.

5. Method in accordance with claim 1 wherein a plurality of shock waves are generated in said pipe conduit.

* * * * *